US007397897B2

(12) United States Patent
Anand et al.

(10) Patent No.: US 7,397,897 B2
(45) Date of Patent: Jul. 8, 2008

(54) COMPOSITE COATING FOR IMPROVED WEAR RESISTANCE FOR X-RAY TUBE BEARINGS

(75) Inventors: Krishnamurhty Anand, Bangalore (IN); Dennis Michael Gray, Delanson, NY (US); Pazhayannur R. Subramanian, Niskayuna, NY (US); Srinidhi Sampath, Bangalore (IN); Carey Shawn Rogers, Brookfield, WI (US); Steven Alfred Tysoe, Ballston Spa, NY (US); Richard Arthur Nardi, Scotia, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 11/551,846

(22) Filed: Oct. 23, 2006

(65) Prior Publication Data

US 2008/0101539 A1 May 1, 2008

(51) Int. Cl.
*H01J 35/28* (2006.01)

(52) U.S. Cl. ..... 378/132; 378/133

(58) Field of Classification Search ..... 378/119, 378/124, 132, 133; 384/490, 492, 527, 627
See application file for complete search history.

(56) References Cited

U.S. PATENT DOCUMENTS

| | | | | | |
|---|---|---|---|---|---|
| 4,293,171 | A | | 10/1981 | Kakumoto et al. | |
| 4,625,324 | A | * | 11/1986 | Blaskis et al. | 378/130 |
| 4,962,519 | A | * | 10/1990 | Upadhya | 378/133 |
| 5,150,398 | A | * | 9/1992 | Nishioka et al. | 378/132 |
| 5,284,394 | A | * | 2/1994 | Lemelson | 384/463 |
| 5,516,214 | A | * | 5/1996 | Kakumoto et al. | 384/492 |
| 5,709,936 | A | | 1/1998 | Besmann et al. | |
| 5,851,675 | A | | 12/1998 | Oyagi et al. | |
| 5,866,518 | A | | 2/1999 | Dellacorte et al. | |
| 5,978,447 | A | * | 11/1999 | Carlson et al. | 378/132 |
| 6,269,146 | B1 | * | 7/2001 | Ohnishi et al. | 378/130 |
| 6,726,993 | B2 | | 4/2004 | Teer et al. | |
| 7,172,343 | B2 | * | 2/2007 | Kinno et al. | 384/492 |
| 2004/0179762 | A1 | * | 9/2004 | Doll et al. | 384/492 |

FOREIGN PATENT DOCUMENTS

| | | | |
|---|---|---|---|
| EP | 0122559 | B1 | 7/1990 |
| EP | 0573722 | A3 | 12/1993 |
| EP | 1228020 | B1 | 6/2004 |
| WO | 9520253 | A3 | 7/1995 |

* cited by examiner

*Primary Examiner*—Irakli Kiknadze
(74) *Attorney, Agent, or Firm*—Eileen W. Gallagher; Patrick K. Patnode

(57) ABSTRACT

A bearing assembly mounted in an x-ray tube includes a bearing race and a bearing ball positioned adjacent to the bearing race. A coating is deposited on one of the bearing race and the bearing ball includes a lubricant and a hard material having a hardness greater than a base material of the bearing race and a base material of the bearing ball.

12 Claims, 5 Drawing Sheets

COMPOSITE COATING FOR IMPROVED WEAR RESISTANCE FOR X-RAY TUBE BEARINGS

BACKGROUND OF THE INVENTION

The present invention relates generally to x-ray tubes and, more particularly, to a coating deposited on an x-ray tube bearing assembly.

X-ray systems typically include an x-ray tube, a detector, and a bearing assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in a computed tomography (CT) package scanner.

X-ray tubes include a rotating anode structure for the purpose of distributing the heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator. An x-ray tube cathode provides a focused electron beam that is accelerated across an anode-to-cathode vacuum gap and produces x-rays upon impact with the anode. Because of the high temperatures generated when the electron beam strikes the target, it is necessary to rotate the anode assembly at high rotational speed. This places stringent demands on the bearing assembly, which includes tool steel ball bearings and tool steel raceways.

Bearings used in x-ray tubes are required to operate in a vacuum, which precludes lubricating with conventional wet bearing lubricants such as grease or oil. X-ray tube bearing rolling elements are typically coated with a solid layer, or tribological system, of a metal with lubricating properties, such as silver, lead, or lead-tin. Silver, applied by an ion plating or an electroplating process, has been used as a lubricating coating for tool steel bearings in x-ray tube applications where the tubes operate under vacuum and at temperatures in the range of 300-500 degrees Celsius. The performance of the silver coating is optimum at an operating stress level of up to 2.5 GPa and a temperature of 400 to 500 degrees Celsius. Failure of a bearing in an x-ray tube is typically by wear of the plated silver and loss of the silver from the contact region.

Silver is also used because of its electrical characteristics. Tube current flows in the x-ray tube from cathode to anode as an electron beam. The tube electrical circuit requires tube current to flow through the bearing assembly, and as such, the current flows through the rolling contact points of the bearing. The electrical circuit may include the races, the balls, and any lubricant or other material that is deposited on the bearing assembly or its components to enhance the life of the bearing. As such, the tribological system on the balls or races must be sufficiently electrically conductive in order for the x-ray tube to operate.

Silver derives its lubricity from the fact that it is a highly ductile single phase noble metal. This property is dependent on operating at temperatures above the recrystallization temperature of silver, which is 0.4 to 0.5 times the melting point of silver. Therefore, silver is not as effective for bearing lubrication when operating below these temperatures, and other soft metals such as Pb and combinations of Pb and Sn have instead been used to lubricate ball bearings in x-ray applications.

Silver lubricant distributes between the balls and races during initial processing and operation of the x-ray tube to form a thin coating on the rolling contact region. Once the silver coating is worn, wear of the base material commences, which leads to increased noise, failure of the lubricant, and can ultimately lead to catastrophic failure of the bearing.

The operating conditions of newer generation x-ray tubes have become increasingly more aggressive in terms of stresses because of G forces imposed by higher gantry speeds and higher anode runspeeds. As a result there is greater emphasis in finding materials solutions for improved performance and higher reliability of the bearing tribological system under the more stringent operating conditions.

Therefore, it would be desirable to have a method and apparatus to improve reliability of the lubricant in the rolling contact region and to improve the useful life of the x-ray bearing.

BRIEF DESCRIPTION OF THE INVENTION

The present invention provides a method and apparatus for enhancing x-ray tube bearing lubricants that overcome the aforementioned drawbacks. A coating between the ball and raceway of a bearing assembly includes an augmented lubrication material to improve the lubricant on the base metal of an x-ray tube bearing and to reduce wear of the base metal of an x-ray bearing.

According to one aspect of the present invention, a bearing assembly is disclosed that is mounted in an x-ray tube, the bearing assembly includes a bearing race, a bearing ball positioned adjacent to the bearing race, and a combination coating deposited on one of the bearing race and the bearing ball, the combination coating comprising a lubricant, and a hard material having a hardness greater than a base material of the bearing race and a base material of the bearing ball.

According to another aspect of the present invention discloses a method of manufacturing an x-ray tube bearing assembly. The method includes providing a bearing ball, providing a bearing race, and depositing a combination coating on one of the bearing race and the bearing ball, the combination coating comprising, a lubricant, and a hard material having a hardness greater than a base material of the bearing race and a base material of the bearing ball.

According to yet another aspect of the present invention, an imaging system is disclosed including an x-ray detector, an x-ray tube having a rotatable shaft, and a bearing assembly supporting the rotatable shaft. The bearing assembly includes a bearing race, a bearing ball positioned adjacent to the bearing race, and a combination coating deposited on one of the bearing race and the bearing ball. The combination coating includes a lubricant and a hard material having a hardness greater than a base material of the bearing race and a base material of the bearing ball.

Various other features and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

The operating environment of the present invention is described with respect to the use of an x-ray tube as used in a computed tomography (CT) system. However, it will be appreciated by those skilled in the art that the present invention is equally applicable for use in other systems that require the use of an x-ray tube. Such uses include, but are not limited to, x-ray imaging systems (for medical and non-medical use), mammography imaging systems, and RAD systems.

Moreover, the present invention will be described with respect to use in an x-ray tube. However, one skilled in the art will further appreciate that the present invention is equally applicable for other systems that require operation of a bearing in a high vacuum, high temperature, and high contact stress environment, wherein a solid lubricant, such as silver, is plated on the rolling contact components. The present invention will be described with respect to a "third generation" CT medical imaging scanner, but is equally applicable with other CT systems, such as a baggage scanner.

Figure 1:
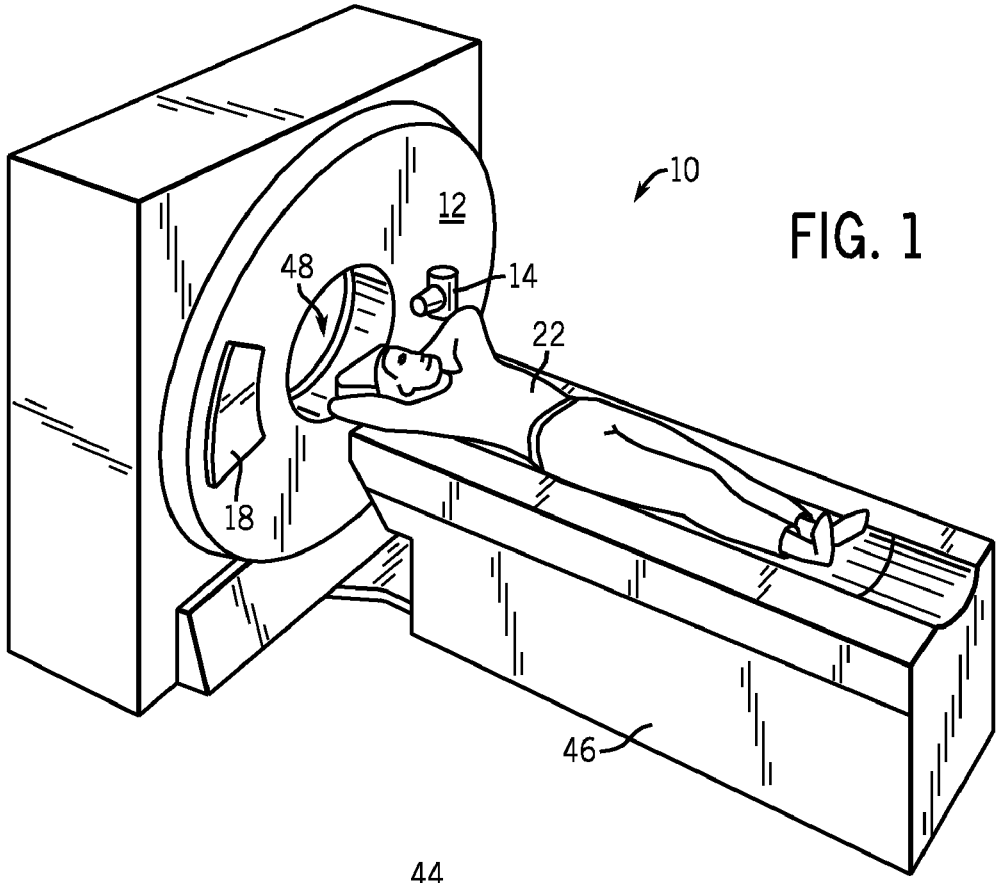
FIG. 1 is a pictorial view of a CT imaging system that can benefit from incorporation of an embodiment of the present invention.
Figure 2:
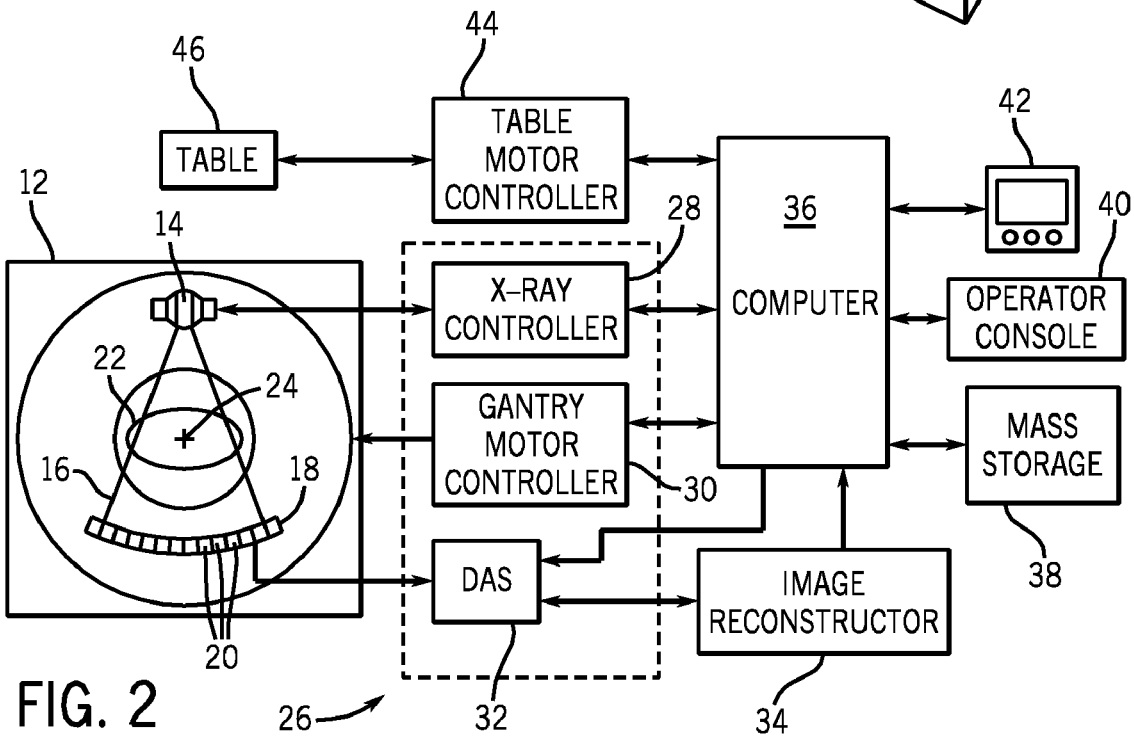
FIG. 2 is a block schematic diagram of the system illustrated in FIG. 1.

Referring to FIGS. 1 and 2, a computed tomography (CT) imaging system 10 is shown as including a gantry 12 representative of a "third generation" CT scanner. Gantry 12 has an x-ray tube 14 that projects a beam of x-rays 16 toward a detector array 18 on the opposite side of the gantry 12. Detector array 18 is formed by a plurality of detectors 20 which together sense the projected x-rays that pass through a medical patient 22. Each detector 20 produces an electrical signal that represents the intensity of an impinging x-ray beam and hence the attenuated beam as it passes through the patient 22. During a scan to acquire x-ray projection data, gantry 12 and the components mounted thereon rotate about a center of rotation 24.

Rotation of gantry 12 and the operation of x-ray tube 14 are governed by a control mechanism 26 of CT system 10. Control mechanism 26 includes an x-ray controller 28 that provides power and timing signals to an x-ray tube 14 and a gantry motor controller 30 that controls the rotational speed and position of gantry 12. A data acquisition system (DAS) 32 in control mechanism 26 samples analog data from detectors 20 and converts the data to digital signals for subsequent processing. An image reconstructor 34 receives sampled and digitized x-ray data from DAS 32 and performs high speed reconstruction. The reconstructed image is applied as an input to a computer 36 which stores the image in a mass storage device 38.

Computer 36 also receives commands and scanning parameters from an operator via console 40 that has a keyboard. An associated cathode ray tube display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 and gantry 12. Particularly, table 46 moves portions of patient 22 through a gantry opening 48.

Figure 3:
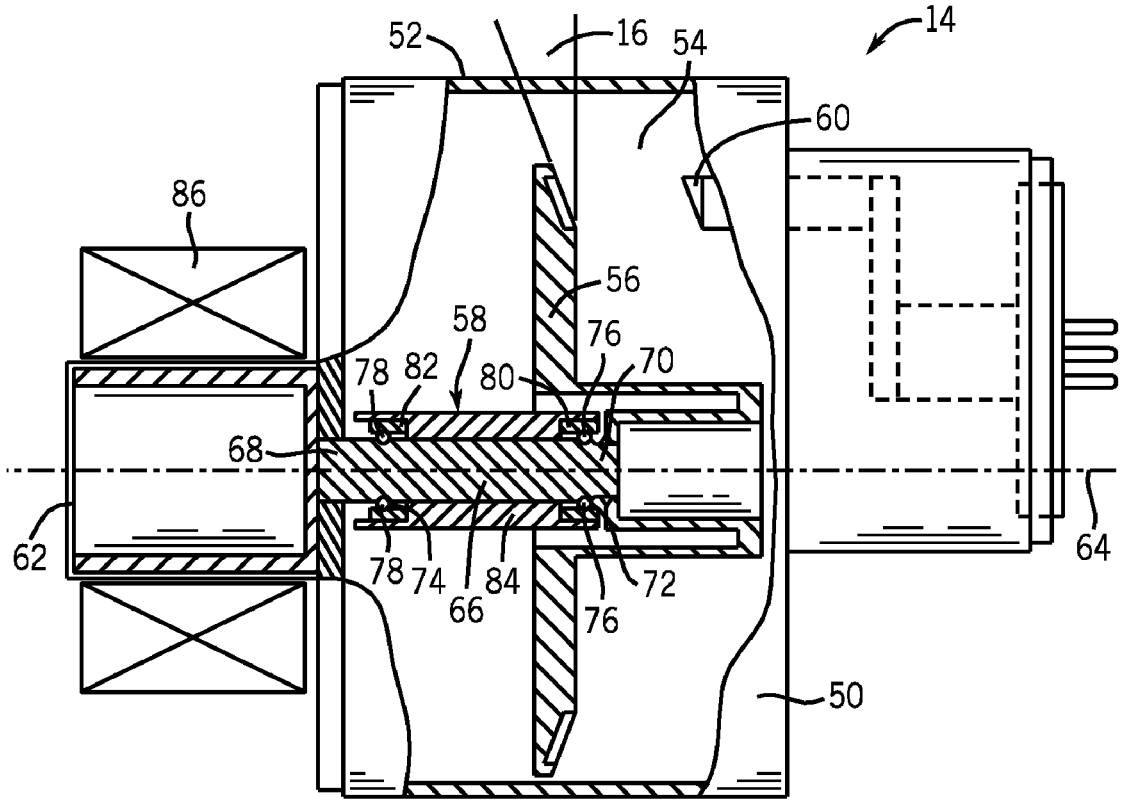
FIG. 3 is a cross-sectional view of an x-ray tube useable with the system illustrated in FIG. 1.

FIG. 3 illustrates a cross-sectional view of an x-ray tube 14 that can benefit from incorporation of an embodiment of the present invention. The x-ray tube 14 includes a casing 50 having a radiation emission passage 52 formed therein. The casing 50 encloses a vacuum 54 and houses an anode 56, a bearing assembly 58, a cathode 60, and a rotor 62. X-rays 16 are produced when high-speed electrons are suddenly decelerated when directed from the cathode 60 to the anode 56 via a potential difference therebetween of, for example, 60 thousand volts or more in the case of CT applications. The x-rays 16 are emitted through the radiation emission passage 52 toward a detector array, such as detector array 18 of FIG. 2. To avoid overheating the anode 56 from the electrons, an anode 56 is rotated at a high rate of speed about a centerline 64 at, for example, 90-250 Hz.

The bearing assembly 58 includes a center shaft 66 attached to the rotor 62 at first end 68 and attached to the anode 56 at second end 70. A front inner race 72 and a rear inner race 74 of center shaft 66 rollingly engage a plurality of front balls 76 and a plurality of rear balls 78, respectively. Bearing assembly 58 also includes a front outer race 80 and a rear outer race 82 configured to rollingly engage and position, respectively, the plurality of front balls 76 and the plurality of rear balls 78. Bearing assembly 58 includes a stem 84 which is supported by the x-ray tube 14. Stator 86 drives rotor 62, which rotationally drives anode 56.

In addition to rotation of the anode 56 within x-ray tube 14, the x-ray tube 14 as a whole is caused to rotate about gantry 12 at rates of, typically, 1 Hz or faster. The rotational effects of both the x-ray tube 14 about the gantry 12 and the anode 56 within the x-ray tube 14 cause the anode 56 weight to be compounded significantly, hence leading to operating contact stresses in the races 72, 74, 80, 82 and balls 76, 78 of up to 2.5 GPa. Additionally, heat generated from operation of the cathode 60, the resulting deceleration of electrons in anode 56, and heat generated from frictional self-heating of the races 72, 74, 80, 82 and balls 76, 78 to operate typically above 400 degrees Celsius. Operation at such high temperatures and operation at high rotational speeds require a lubricant to be applied between races 72, 74, 80, 82 and balls 76, 78 in order to reduce friction therebetween.

Silver is typically used as the lubricant when operating temperatures of the x-ray tube 14 exceed 400 degrees Celsius. Silver may be applied to the races 72, 74, 80, 82 or balls 76, 78 or to both in x-ray tube applications. When applied to balls 76, 78 silver is usually applied by, for instance, ion plating or electroplating. Silver minimizes formation of adhesive junctions between the base materials of the 72, 74, 80, 82 and balls 76, 78. Being a relatively soft coating, silver is able to transfer from, for example, the lubricated balls 76, 78 to races 72, 74, 80, and 82 and maintain low friction therebetween. Optimal operating stresses of an x-ray tube typically range from 1-2.5 GPa with optimal temperatures typically ranging from 400-500 degrees Celsius.

Silver is a face-centered cubic (FCC) alloy which minimally work hardens above 400 degrees Celsius. Additionally, silver plastically flows easily to form a transfer film that prevents tool steel to tool steel adhesive wear processes between bearing balls 76, 78 and races 72, 74, 80, and 82. As such, silver is a preferred lubricant when the operating temperature is above 400 degrees Celsius. However, the ability of silver to plastically flow is not retained at lower temperatures (e.g. <400 degrees Celsius). To improve the lubricity and enhance the performance of silver over a wider temperature range, other solid lubricants may be added thereto.

FIGS. 4-10 illustrate embodiments of the present invention that include a partial cross-sectional view of a base material in bearing assembly 58 to which the embodiments may be applied. One skilled in the are would recognize that the base material may pertain to a tool steel ball 76, 78 a race 72, 74, 80, and 82 or both. The base material may include tool steels typically used for bearing materials, such as Rex® 20, T5, T15 tool steels, and the like. Rex is a registered trademark of Crucible Materials Corporation, Solvay, N.Y.

Figure 4:
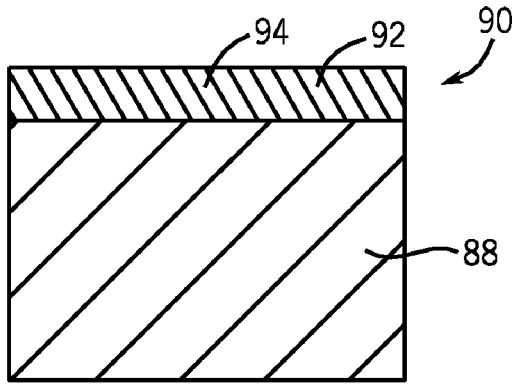
FIG. 4 is a partial cross-sectional view of a base material having a combination material according to one embodiment of the present invention.
Figure 5:
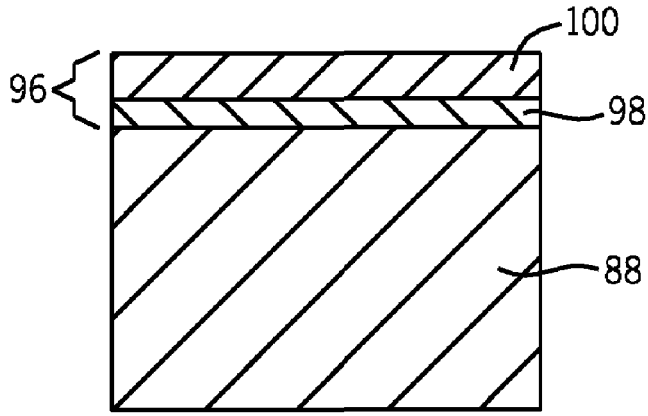
FIG. 5 is a partial cross-sectional view of a base material having a combination material according to another embodiment of the present invention.
Figure 6:
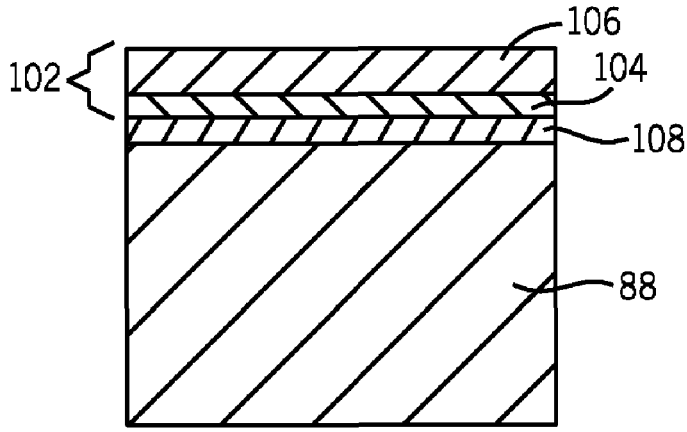
FIG. 6 shows the embodiment of FIG. 5 having an improved interlayer adhesion between the base material and the first layer.

Referring to FIGS. 4-6, a combination of silver and another lubricant is applied to the base material for improved lubricity. The silver may be applied before the second lubricant, or the silver may be applied simultaneously with the second lubricant. An adhesion promoter is also disclosed to enhance adhesion between the lubricant and the base material.

FIG. 4 is a partial cross-sectional view of a base material 88 having a combination material 90 applied thereto, according to one embodiment of the present invention. The combination material 90 includes silver 92 and another lubricant 94 such as tungsten disulfides (WS2), molybdenum disulfide (MoS2), calcium fluoride (CaF2), and the like. In a preferred embodiment, combination material 90 may be co-sputtered or composite plated simultaneously on base material 88. In co-sputtering, silver and lubricants are sputtered in a physical vapor deposition (PVD) system, accelerated in a plasma, and deposited on a tool steel ball to form combination material 90. In composite plating, the base material 88 to be coated serves as a cathode in a silver-based electrolytic bath and solid particles of 1 to 5 microns in size are suspended in the electrolyte for co-depositing on the cathode. The combination material 90 deposited on base material 88 enhances lubrication performance, which improves the life of the bearing assembly 58.

FIG. 5 is a partial cross-sectional view of a base material 88 having a combination material 96 applied thereto, according to another embodiment of the present invention. A first layer 98 of silver is deposited on base material 88, and a second layer 100 is deposited on the first layer 98. Second layer 100 includes a lubrication material other than silver such as WS2, MoS2, CaF2, CaF2BaF2 eutectics, and the like. In a preferred embodiment, the second layer 100 is sputtered on the first layer2 98 as a thin film. In this manner, the second layer 100, together with the first layer 98, enhances the lubrication performance and life of the bearing assembly 58.

FIG. 6 shows the embodiment of FIG. 5 having an improved interlayer adhesion between the base material 88 and a combination material 102. An adhesion layer 108 of a Ti or a Cr metal is deposited on base material 88 prior to depositing the first layer 104 of silver and a second layer of lubricant 106 that includes a lubrication material other than silver such as WS2, MoS2, CaF2, CaF2BaF2 eutectics, and the like. Ti and Cr metals promote adhesion between the first layer 104 of silver and the base material 88 through a finite mutual solubility with silver and the base metal. Ti and Cr metals 108 provide both mechanical adhesion provided through the deposition process and chemical adhesion between base material 88 and first layer 104 of silver. The adhesion layer 108 is preferably deposited on base material 88 with a thickness from 10 to 100 nm. The adhesion layer 108 improves adhesion uniformity of the first layer 104 across the surface of the base material 88 over the underlying multi-phase microstructure of the base material 88 alone.

Referring to FIGS. 7-10, an improved wear resistance to the base metal is achieved by applying a hard material to the base material and applying lubricant thereto.

Figure 7:
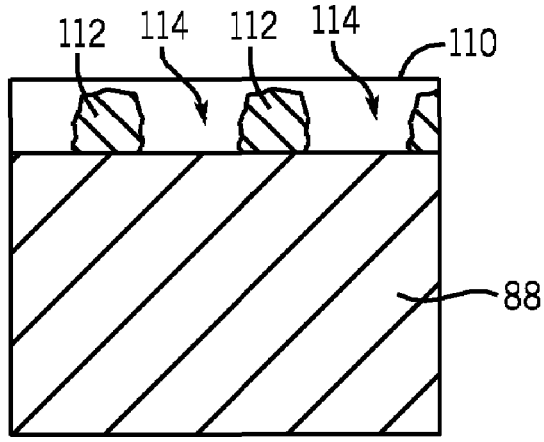
FIG. 7 is a partial cross-sectional view of a base material having improved mechanical support of the silver according to another embodiment of the present invention.

FIG. 7 is a partial cross-sectional view of base material 88 having a coating of silver 110 and low friction, hard particulates 112 according to one embodiment of the present invention. Silver 110 is entrapment-plated onto base material 88 with the hard particulates 112 of submicron size, for example, 20 to 250 nm in diameter. The hard particulates 112 include materials such as TiN, TiAlN, diamond, silicon nitride, silicon carbide, nickel-diamond, and the like having a higher hardness, at x-ray tube operating temperatures, than the base material 88. The hard particulates 112 constrain the silver 110 in valleys 114 between the hard particulates 112 and assist the silver 110 when undergoing bearing rolling contact forces. The adhesion of the silver 110 to hard particulates 112 can be improved by first applying ion beam assisted deposition (IBAD) Cu+IBAD Ag, or Ni/Cu—D+IBAD Ag before depositing silver 110.

Figure 8:
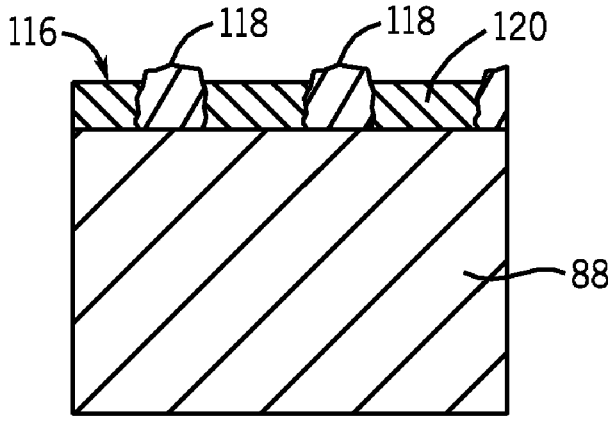
FIG. 8 is a partial cross-sectional view of a base material having islands of silver in a hard metal according to another embodiment of the present invention.

FIG. 8 is a partial cross-sectional view of a base material 88 having a coating 116 including islands of silver 118 co-deposited with a low soluble hard metal 120 according to one embodiment of the present invention. The hard metal 120 includes iron, cobalt, molybdenum, nickel, and the like which have limited mutual solubility at deposition and use temperatures, typically up to 550 degrees Celsius. Hard metals 120 are harder than the lubricant, and inhibit loss of lubricant during operation of the bearing. Molybdenum, when co-deposited with the islands of silver 118, may be selectively sulphidized to MoS2, which has extremely low friction in a vacuum. The islands of silver 118 having, for example, diameters from 10 to 1000 nm, are dispersed in a matrix of the hard metal 120. During rolling contact, silver 118 is dispersed about the hard metal 120 to form a lubrication film thereon. Deformation of the coating 116 is low due to the hardness of the hard metal 120.

Figure 9:
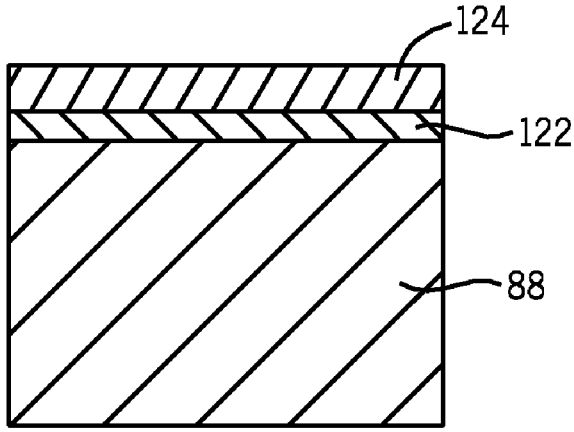
FIG. 9 is a partial cross-sectional view of a base material with hard coating and lubricant according to one embodiment of the present invention.

FIG. 9 is a partial cross-sectional view of base material 88 having a layer of hard coating 122 and a layer of lubricant 124 deposited thereon according to one embodiment of the present invention. The layer of hard coating 122 is deposited on the base material 88 as described hereinbelow and is harder than base material 88. The layer of hard coating 122 reduces slip by maintaining curvature of the base material 88 during the life of the bearing assembly 58. Lubricant 124 is deposited on the layer of hard coating 122 and includes silver, WS2, MoS2, CaF2, CaF2BaF2 eutectics, and the like, or combinations thereof.

In one embodiment, the hard coating 122 includes a monolithic nitride coating deposited by PVD, chemical vapor deposition (CVD) or deposited through ion nitriding. Nitride coatings can be doped with Cl ions by injecting traces of additional TiCl4 during processing. The nitrides can include TiN or other metallic alloyed nitrides. An advantage of the CVD process is that it can be integrated with the tool steel heat treatment cycle, then air quenched and tempered.

In another embodiment, hard coating 122 includes multiple layers of nitride such as TiNZrN. Nitrides enhance overall adhesion between the base material 88 and the lubricant 124. The thickness of each layer is preferably 100 nm or lower, while the thickness of the combined layers is preferably not greater than 10 microns.

In yet another embodiment, hard coating 122 includes carbide and oxide coatings with lubricating phases. A CerMet (ceramic and metal) coating such as WC—Co(Cr) or Metal matrix/alumina is co-deposited with a moderate temperature lubricant phase capable of operating in vacuum, such as MoS2, WS2, CaF2, CaF2BaF2 eutectics. These coatings can be deposited by a High Velocity Oxygen Fuel (HVOF) process, to produce a dense adherent coating.

Figure 10:
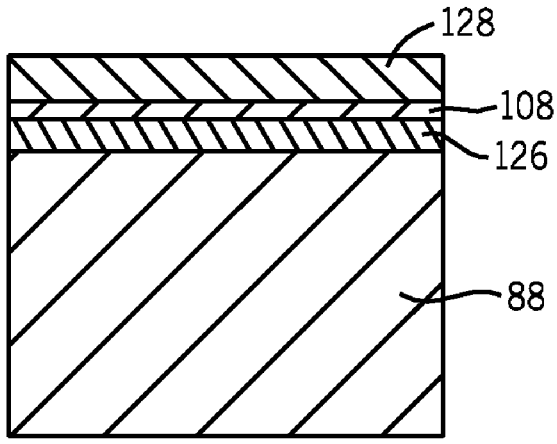
FIG. 10 shows the embodiment of FIG. 9 having an improved interlayer adhesion.

FIG. 10 shows the embodiment of FIG. 9 having an improved interlayer adhesion. A layer of hard ceramic 126, such as mono- or nanomulti-layer nitrides, carbides, or borides, is deposited on the base material 88. An adhesion layer 108 of a Ti or a Cr metal is deposited on the layer of hard ceramic 126 as an adhesion promoting interlayer to a thickness of, for example, 10 to 100 nm. A layer of silver 128 is then deposited on the adhesion layer 108. Ti and Cr metals 108 have solubility both in the layer of hard ceramic 126 as well as the layer of silver 128 layer, thus providing a chemically enhanced adhesion between the silver 128 and the layer of hard ceramic 126.

Figure 11:
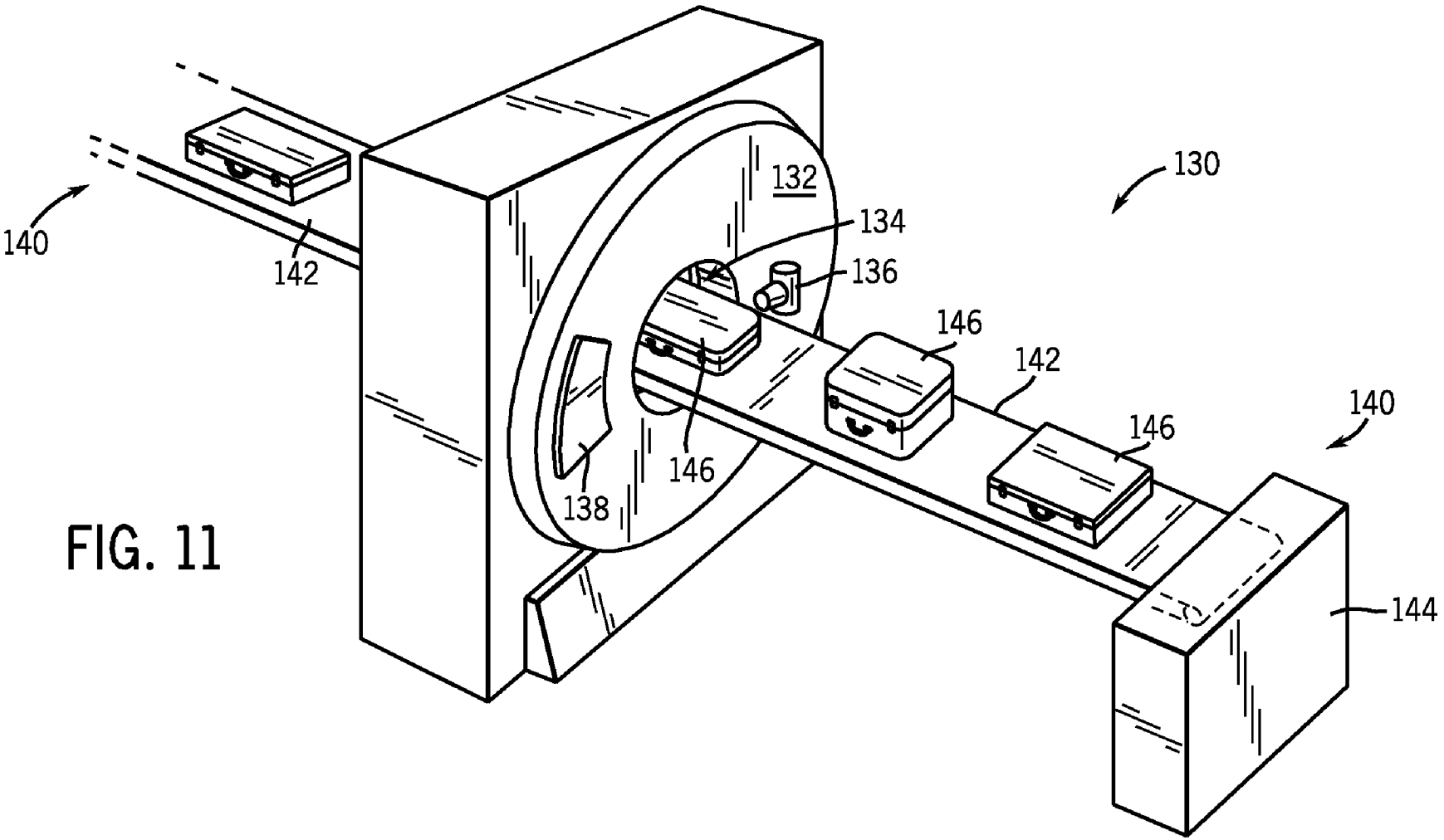
FIG. 11 is a pictorial view of a CT system for use with a non-invasive package inspection system.

FIG. 11 is a pictorial view of a CT system for use with a non-invasive package inspection system. Package/baggage inspection system 130 includes a rotatable gantry 132 having an opening 134 therein through which packages or pieces of baggage may pass. The rotatable gantry 132 houses a high frequency electromagnetic energy source 136 as well as a detector assembly 138 having scintillator arrays comprised of scintillator cells. A conveyor system 140 is also provided and includes a conveyor belt 142 supported by structure 144 to automatically and continuously pass packages or baggage pieces 146 through opening 134 to be scanned. Objects 146 are fed through opening 134 by conveyor belt 142, imaging data is then acquired, and the conveyor belt 142 removes the packages 146 from opening 134 in a controlled and continuous manner. As a result, postal inspectors, baggage handlers, and other security personnel may non-invasively inspect the contents of packages 146 for explosives, knives, guns, contraband, etc.

According to one embodiment of the present invention, a bearing assembly is disclosed that is mounted in an x-ray tube, the bearing assembly includes a bearing race, a bearing ball positioned adjacent to the bearing race, and a combination coating deposited on one of the bearing race and the bearing ball, the combination coating comprising a lubricant, and a hard material having a hardness greater than a base material of the bearing race and a base material of the bearing ball.

According to another embodiment of the present invention discloses a method of manufacturing an x-ray tube bearing assembly. The method includes providing a bearing ball, providing a bearing race, and depositing a combination coating on one of the bearing race and the bearing ball, the combination coating comprising, a lubricant, and a hard material having a hardness greater than a base material of the bearing race and a base material of the bearing ball.

According to yet another embodiment of the present invention, an imaging system is disclosed including an x-ray detector, an x-ray tube having a rotatable shaft, and a bearing assembly supporting the rotatable shaft. The bearing assembly includes a bearing race, a bearing ball positioned adjacent to the bearing race, and a combination coating deposited on one of the bearing race and the bearing ball. The combination coating includes a lubricant and a hard material having a hardness greater than a base material of the bearing race and a base material of the bearing ball.

The present invention has been described in terms of the preferred embodiment, and it is recognized that equivalents, alternatives, and modifications, aside from those expressly stated, are possible and within the scope of the appending claims.

The invention claimed is:

1. A bearing assembly mounted in an x-ray tube, the bearing assembly comprising:

a bearing race;

a bearing ball positioned adjacent to the bearing race; and a combination coating deposited on one of the bearing race and the bearing ball, the combination coating comprising:

a lubricant; and a hard material having a hardness greater than a base material of the bearing race and a base material of the bearing ball and wherein the hard material is a hard coating comprising one of a monolithic nitride, a nano multilayered nitride, a nickel-diamond coating, a ceramic, and a carbon and oxide coating with lubricating phase.

2. The bearing assembly of claim 1 wherein the ceramic is one of a mono-layer nitride, a carbide of boride, a nano multilayer nitride, a nano multilayer carbide, and a nano multilayer boride.

3. The bearing assembly of claim 1 wherein the monolithic nitride is doped with Cl ions during processing.

4. The bearing assembly of claim 1 wherein the lubricant comprises silver, wherein the hard coating comprises nickel-diamond; and wherein the combination coating further comprises one of IBAD Cu+IBAD Ag and Ni/Cu—D+IBAD Ag deposited on the nickel diamond coating between the lubricant and the hard material.

5. The bearing assembly of claim 1 wherein the combination further comprises an adhesion promoter comprising one of Ti and Cr deposited on the ceramic.

6. A method of manufacturing an x-ray tube bearing assembly, the method including:

depositing a combination coating on one of a bearing race and a bearing ball, the combination coating comprising:

a lubricant;

a hard material having a hardness greater than a base material of the one of a bearing race and a bearing ball; and depositing the hard material on the base material, the hard material comprising one of a monolithic nitride, a nano multilayered nitride, a nickel-diamond coating, a ceramic, and a carbon and oxide coating with lubricating phase.

7. The method of claim 6 wherein the step of depositing the hard material comprises depositing the ceramic, wherein the ceramic comprises one of mono-layer nitrides, carbides of borides, nano multilayer nitrides, nano multilayer carbides, and nano multilayer borides.

8. The method of claim 7 further comprising the step of depositing an adhesion promoter comprising one of Ti and Cr on the ceramic.

9. The method of claim 6 wherein the step of depositing the hard material comprises depositing the monolithic nitride; and further comprising the step of doping the monolithic nitride with Cl ions during processing.

10. The method of claim 6 wherein the step of depositing the hard material comprises depositing the nickel-diamond coating; and further comprising depositing one of IBAD Cu+IBAD Ag and Ni/Cu—D+IBAD AG on the nickel-diamond coating.

11. An imaging system comprising:

an x-ray detector;

an x-ray tube having a rotatable shaft; and a bearing assembly supporting the rotatable shaft, the bearing assembly comprising:

a bearing race;

a bearing ball positioned adjacent to the bearing race; and a combination coating deposited on one of the bearing race and the bearing ball, the combination coating comprising:

a lubricant;

a hard material having a hardness greater than a base material of the bearing race and a base material of the bearing ball; and wherein the hard material is a hard coating comprising one of a monolithic nitride, a nano multilayered nitride, a nickel-diamond coating, a ceramic, and a carbon and oxide coating with lubricating phase.

12. The imaging system of claim 11 wherein the lubricant comprises silver, wherein the hard coating comprises nickel-diamond, and wherein the combination coating further comprises one of IBAD Cu+IBAD Ag and Ni/Cu—D+IBAD Ag deposited on the nickel diamond coating between the lubricant and the hard material.

* * * * *

UNITED STATES PATENT AND TRADEMARK OFFICE

CERTIFICATE OF CORRECTION

PATENT NO. : 7,397,897 B2
APPLICATION NO. : 11/551846
DATED : July 8, 2008
INVENTOR(S) : Anand et al.

It is certified that error appears in the above-identified patent and that said Letters Patent is hereby corrected as shown below:

On the Title Page, item (75), under "Inventors", in Column 1, Line 1, delete "Krishnamurhty" and insert -- Krishnamurthy --, therefor.

Signed and Sealed this

Eighteenth Day of November, 2008

JON W. DUDAS
*Director of the United States Patent and Trademark Office*